US006305687B1

(12) United States Patent
Pollock et al.

(10) Patent No.: US 6,305,687 B1
(45) Date of Patent: Oct. 23, 2001

(54) SEAL CARD GAME AND METHOD OF PLAYING SAME

(75) Inventors: Gregory T. Pollock, Cleveland, OH (US); Ernest C. Medeiros, Pittsburg, CA (US)

(73) Assignee: Arrow International, Inc., Cleveland, OH (US)

( * ) Notice: Subject to any disclaimer, the term of this patent is extended or adjusted under 35 U.S.C. 154(b) by 0 days.

(21) Appl. No.: 09/318,508

(22) Filed: May 25, 1999

Related U.S. Application Data

(60) Provisional application No. 60/087,023, filed on May 28, 1998.

(51) Int. Cl.[7] ..... A63F 3/06
(52) U.S. Cl. ..... 273/269; 463/19
(58) Field of Search ..... 273/269, 270, 273/271, 138.1; 463/16–19

(56) References Cited

U.S. PATENT DOCUMENTS 4,740,016 * 4/1988 Konecny .
4,775,155 * 10/1988 Lees .
4,943,090 * 7/1990 Fienberg .
5,158,293 * 10/1992 Mullins .
5,419,592 * 5/1995 Stuart .
5,472,210 * 12/1995 Fioravanti .
5,544,881 * 8/1996 Rua .
5,560,608 * 10/1996 Silverschotz .
5,613,680 * 3/1997 Groves .
5,657,991 * 8/1997 Camarato .
5,671,921 * 9/1997 Quinlan .
5,887,906 * 3/1999 Sultan .
5,934,671 * 8/1999 Harrison .

OTHER PUBLICATIONS

Arrow International Inc. 1994 BINGO catalog cover page and pp. 1, 13, and 18–22.

* cited by examiner

*Primary Examiner*—Benjamin H. Layno
*Assistant Examiner*—V K Mendiratta
(74) *Attorney, Agent, or Firm*—Fay, Sharpe, Fagan, Minnich & McKee, LLP

(57) ABSTRACT

A "lottery-type" game of chance for one or more players employs break open tickets (10) which have printed on them a matrix (38) of characters (40), such as a 3×3 number matrix. Each ticket includes a unique pattern of numbers, which differs from others in a set of the tickets. The numbers (40) are covered, prior to play, with a removable cover member (32), such as a flap or scratch off seal. The game can be played in a variety of different ways, dependent upon the pattern (such as any line, the letter "X", or coverall) which is chosen as the winning pattern. The game is played by employing a random number generator. The players dab their ticket if the number generated is present on their ticket. The player who first completes the game, by competing the preselected pattern from the numbers called, wins the game. The winning face can be verified by a verification number (62) which is printed on each card. Since no price is listed on the ticket, no payout is established and a proprietor can design its own game.

34 Claims, 5 Drawing Sheets

| FORM # | CARDS | CARD NUMBERS | PACK/CASE |
|---|---|---|---|
| TAC 1 | 150 | 1-150 | 36 |
| TAC 2 | 150 | 151-300 | 36 |
| TAC 3 | 150 | 301-450 | 36 |

Average Number of Calls

| Pattern | 150 Cards | 300 Cards | 450 Cards |
|---|---|---|---|
| Any Line (8 Ways to Win) | 7.72 | 6.46 | 5.83 |
| Postage Stamp (4 Ways to Win) | 15.78 | 13.69 | 12.63 |
| Any 2 Lines (28 Ways to Win) | 16.43 | 14.57 | 13.58 |
| 4 Corners | 21.75 | 18.91 | 17.44 |
| Crazy T (4 Ways to Win) | 21.34 | 18.90 | 17.63 |
| Diamond | 27.10 | 23.99 | 22.37 |
| Letter X | 27.22 | 24.12 | 22.48 |
| Cross | 27.59 | 24.55 | 22.92 |
| Outside Frame | 40.00 | 37.10 | 35.50 |
| Coverall | 42.96 | 40.20 | 38.66 |

Average Number of Winners

| Pattern | 150 Cards | 300 Cards | 450 Cards |
|---|---|---|---|
| Coverall | 1.11 | 1.13 | 1.13 |
| Outside Frame | 1.11 | 1.13 | 1.13 |
| Diamond | 1.10 | 1.12 | 1.13 |
| Letter X | 1.10 | 1.12 | 1.14 |
| Crazy T (4 Ways to Win) | 1.11 | 1.14 | 1.15 |
| Cross | 1.13 | 1.15 | 1.16 |
| Any 2 lines (28 Ways to Win) | 1.14 | 1.18 | 1.20 |
| 4 Corners | 1.15 | 1.18 | 1.21 |
| Postage Stamp (4 Ways to Win) | 1.15 | 1.20 | 1.23 |
| Any Line (8 Ways to Win) | 1.19 | 1.25 | 1.28 |

Percentage of Single Winners

| Pattern | 150 Cards | 300 Cards | 450 Cards |
|---|---|---|---|
| Any Line (8 Ways to Win) | 84.11% | 80.03% | 78.46% |
| Postage Stamp (4 Ways to Win) | 87.12% | 84.15% | 82.54% |
| Any 2 Lines (28 Ways to Win) | 87.47% | 84.66% | 83.24% |
| 4 Corners | 87.32% | 84.69% | 83.26% |
| Cross | 89.07% | 87.12% | 86.34% |
| Crazy T (4 Ways to Win) | 89.87% | 88.07% | 87.00% |
| Letter X | 90.92% | 89.47% | 88.48% |
| Outside Frame | 90.28% | 89.01% | 88.50% |
| Diamond | 90.91% | 89.59% | 88.58% |
| Coverall | 90.01% | 89.05% | 88.90% |

FIG. 5

SEAL CARD GAME AND METHOD OF PLAYING SAME

This application claims the priority of U.S. Provisional Application Serial No. 60/087,023, filed May 28, 1998.

BACKGROUND OF THE INVENTION

The present invention relates to gaming systems and, more particularly, to a lottery-type gaming system.

Lottery-type games of chance have exhibited enduring popularity since such games typically permit a player to make a relatively small investment—by buying a ticket—with a chance of winning a significantly larger award. In addition to the entertainment value that such games provide for the players, these types of games typically provide a source of revenue for the operator, normally a charity, but sometimes a municipality or a business establishment.

Another popular game of chance is BINGO. The most popular form of BINGO played in the United States consists of a 5×5 matrix of numbers with each column of numbers listed under a letter of the word "BINGO" printed at the top of the page. There are seventy-five numbers that may be used in the game such that the numbers 1–15 are listed under the letter "B"; the numbers 16–30 are listed under the letter "I"; numbers 31–45 are listed under the letter "N"; the numbers 46–60 are listed under the letter "G" and the numbers 61–75 are listed under the letter "O." There is usually, but not necessarily, a center space of the matrix which falls under the letter "N" that is designated as a free space in the play of the game. The game is played by filling a prescribed pattern on the BINGO face by marking the randomly generated numbers called from the seventy-five numbers employed in the game. The first person to fill the pre-specified pattern and to call "Bingo" wins the game.

However, it would be desirable to combine a lottery-type game of chance with a BINGO-type game. As both such games are quite popular, it is expected that a combination of these games would also prove popular.

It has, therefore, been considered desirable to develop a new and improved seal card game and method for playing same which would meet the above stated needs and others and provide advantageous overall results.

SUMMARY OF THE INVENTION

In accordance with one embodiment of the present invention, a ticket is provided for use in playing a game of chance. The ticket forms one of a set of tickets and includes a ticket body having front and rear surfaces. A matrix of characters is printed on the rear surface. Each of the characters is different from the other characters in the matrix. The characters are selected such that the matrix differs from matrices of each of the other tickets in the set of tickets. A removable cover member is secured to the rear surface for concealing the matrix of characters prior to playing the game of chance.

In accordance with more limited aspects of this embodiment, the cover member may include one or more flaps, which are connected to the rear surface and are perforated around a periphery for tearing open. Alternatively, the cover member includes a scratch off seal or seals which conceal the characters until scratched off. The matrix of characters is preferably a three character by three character matrix, the matrix differing from the matrices of each of the other tickets in the set by at least three of the characters. The characters may be letters or numbers, such as the numbers in the set 1–75. Preferably, a spatially arranged group of the characters forms a pattern (e.g., horizontal line, vertical line, four corners, a diamond shape, full cover, a T-shape, a cross, a frame, or the like) the group of characters forming the pattern being different from an equivalently positioned spatially arranged group of characters for each of the other tickets in the set. A verification number, such as a bar code, may be located on one of the front and rear surfaces, preferably concealed by the cover member, for verifying that the matrix of characters has not been altered. A serial number may also be located on one of the surfaces for distinguishing the ticket from other tickets outside the set of tickets.

In accordance with another aspect of the present invention, a set of tickets for use in playing a game of chance is provided. Each ticket of the set of tickets includes a front surface and a rear surface. A matrix of characters is printed on the rear surface. Each of the characters is different from the other characters in the matrix. The characters are selected such that the matrix differs from the matrices of each of the other tickets in the set of tickets. A removable cover member is connected to the rear surface and positioned over the matrix of characters for concealing the matrix of characters prior to playing the game of chance.

In accordance with more limited aspects of this embodiment of the present invention, the matrix of characters comprises a 3×3 matrix, such as BINGO numbers. The removable cover member may comprise a tear-open flap. Each ticket preferably comprises a two-ply construction, in which the front and rear surfaces are located on a first ply and the removable cover is formed in a second ply.

In accordance with yet another embodiment of the present invention, a method of using a ticket in playing a game of chance is provided. The ticket forms one of a set of tickets. The method comprises providing a set of tickets in which each ticket includes a rear surface having a matrix of characters concealed by a cover member. Each of the characters is different from the other characters in the matrix. The characters are selected such that the matrix differs from the matrices of each of the other tickets in the set of tickets. The method further includes removing the cover member from the ticket to reveal a matrix of characters and comparing the ticket characters with randomly-generated characters to determine whether a group of the randomly-generated characters corresponds with at least one preselected spatially oriented group of the ticket characters.

In accordance with one aspect of this embodiment of the present invention, the step of comparing the ticket characters includes the steps of generating a first randomly generated character and comparing the ticket characters with the randomly generated character, marking one of the ticket characters if the randomly generated character corresponds with one of the ticket characters, and repeating the steps of generating and marking until one of the tickets in the set of tickets is marked with a preselected pattern.

One advantage of the present invention is the provision of a new and improved seal card game and method of playing same.

Another advantage of the present invention is the provision of a seal card game which employs randomly drawn numbers in its play.

Still another advantage of the present invention is the provision of a seal card game in which the winners are not known until a random number generator has chosen a plurality of numbers which are reflected in a predetermined pattern on a number matrix located in a window of a concealed section of the seal card game.

Yet another advantage of the present invention is the provision of a seal card game having an N×M matrix of numbers in which the permutations of numbers on each card have the following properties: unique lines, horizontal, vertical and diagonal, as well as unique four corners, letter X's, diamonds, crosses, crazy T's, large frames, postage stamps and two lines, and the like.

A further advantage of the present invention is the provision of a seal card game employing a N×M number matrix in which each card is different from all other cards by at least three numbers and usually by four or more numbers or that a selected game pattern is unique.

A still further advantage of the present invention is the provision of a seal card game in which patterns of numbers are so chosen as to reduce the potential for multiple winners for any single game.

A yet further advantage of the present invention is the provision of a seal card game in which no ticket price is printed on the ticket and, therefore, no specific payout is established. In this way, the proprietor of the game can design its own game. Thus, the game tickets can be used like a BINGO ticket, like a pull tab ticket, like a tear-open ticket or as combinations of those games.

Still further advantages of the present invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE PREFERRED EMBODIMENTS

Figure 1:
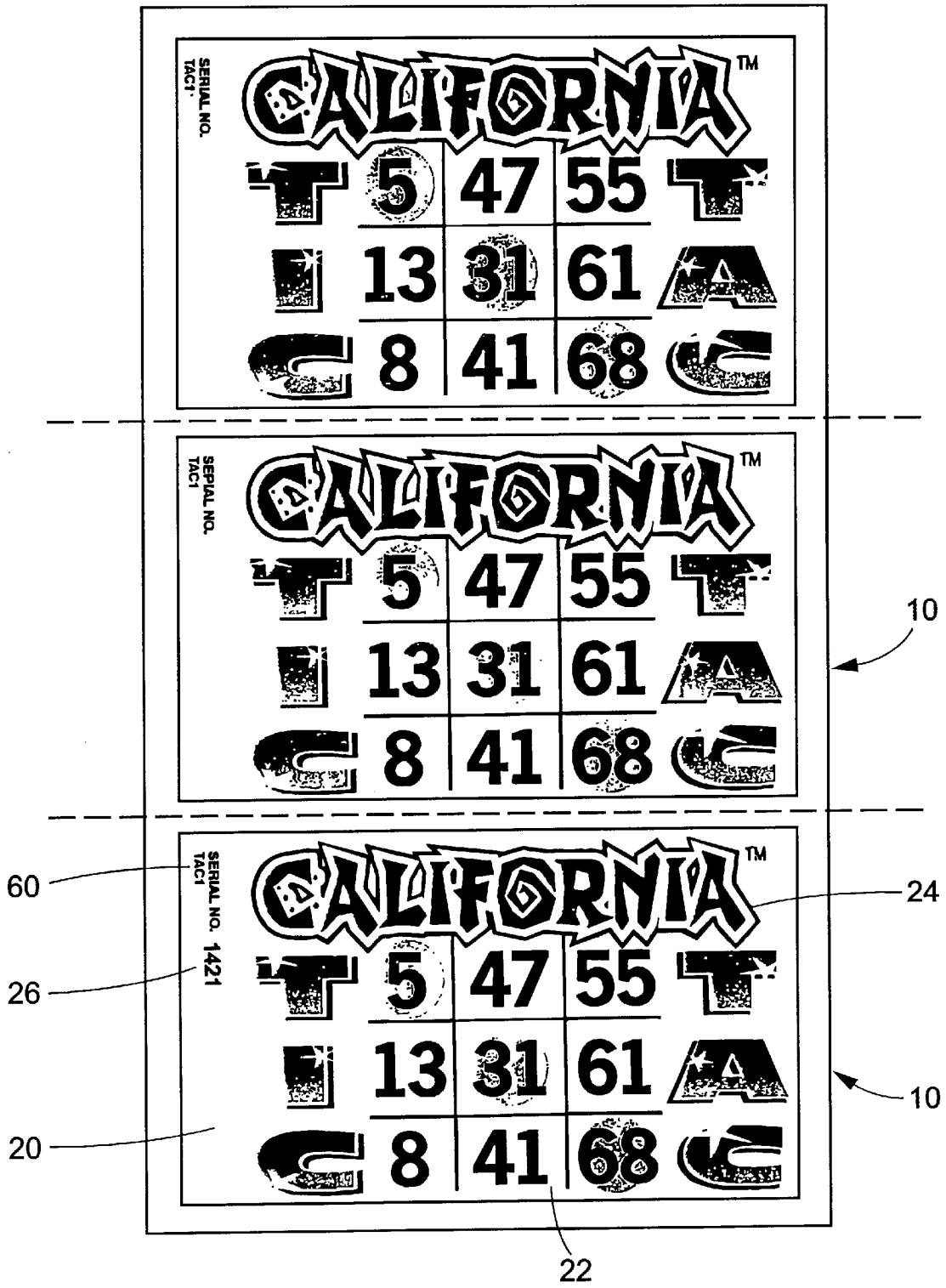
FIG. 1 is a top plan view of a front face of three tickets according to the preferred embodiment of the present invention.

While this invention is susceptible of embodiment in many different forms, there is shown in the drawings and will herein be described in detail, two preferred embodiments of the invention. However, it should be understood that the present disclosure is to be considered only as exemplifying the principles of the invention and is not intended to limit the invention to the embodiment illustrated.

FIG. 1 illustrates the ticket or playing card 10 according to the present invention. Three such tickets are illustrated as they may be printed on a web in a tandem fashion. The playing card 10 is exemplary of the present invention in that the present game system includes a plurality of such playing cards such as, for example, 150 cards, or 300 cards or even up to 450 cards. Each of these playing cards 10 is separately purchased by a game player.

Figure 2:
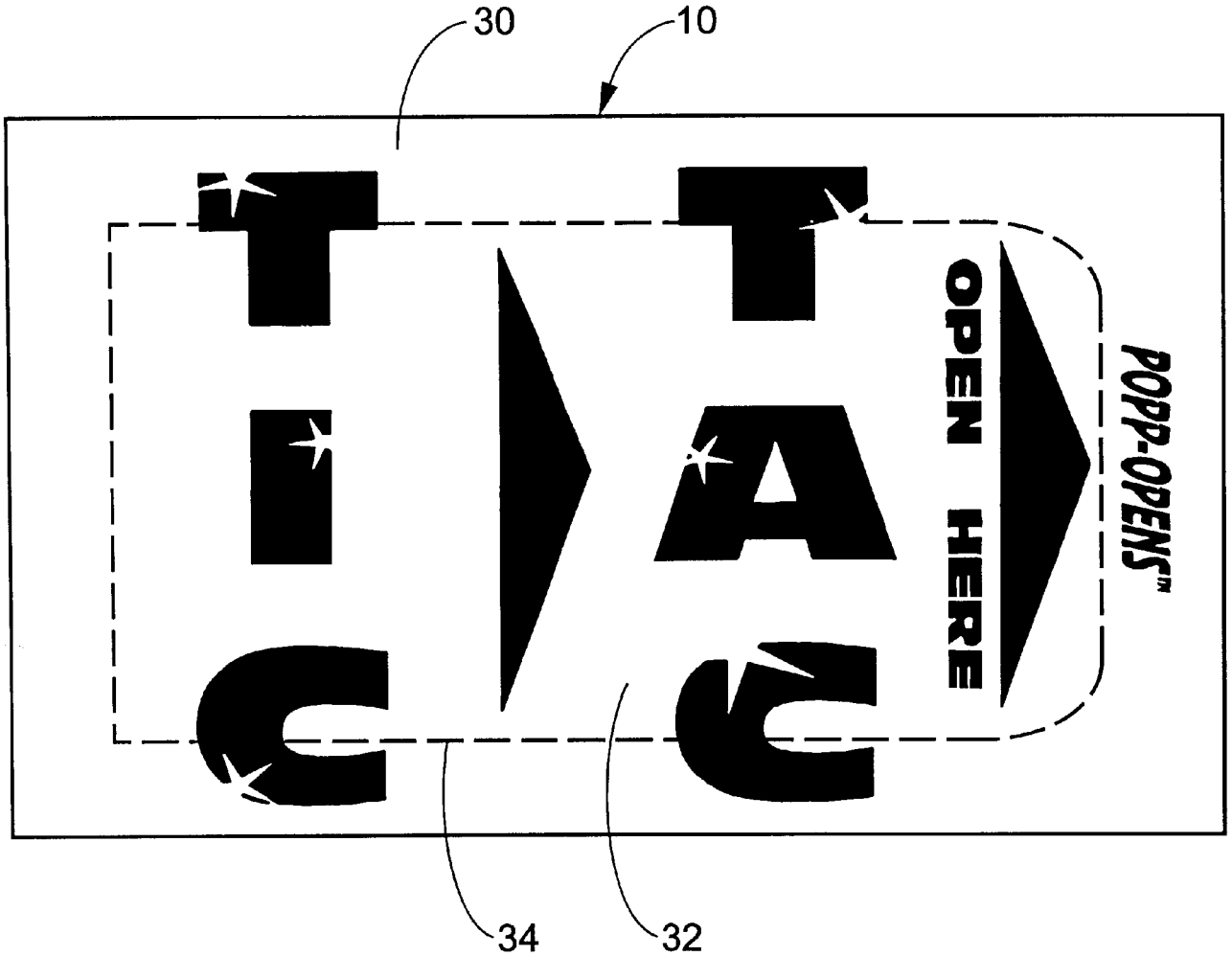
FIG. 2 is an enlarged bottom plan view of one of the tickets of FIG. 1 with the ticket being in an unopened condition.
Figure 3A:
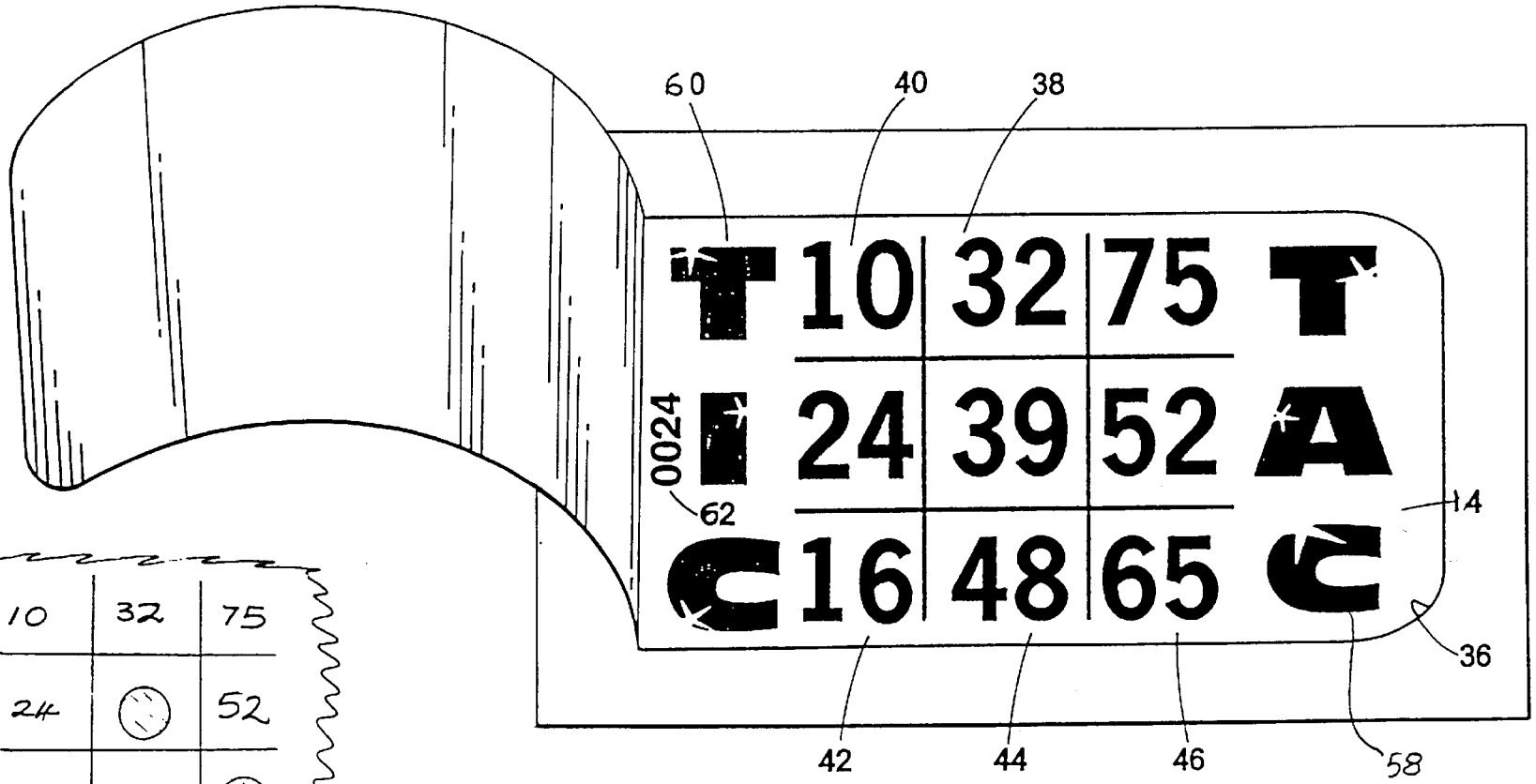
FIG. 3A is a bottom plan view of the ticket of FIG. 2 with the flap of the ticket being pulled back to reveal the 3×3 matrix beneath the window covered by the flap.

With reference also to FIGS. 2 and 3A, each of the playing cards includes a body 12 with a playing surface or reverse side 14 and a front surface 20. As shown in FIG. 1, the front surface 20 displays an example 22 of a matrix, such as a 3×3 number matrix, which is hidden on the reverse side 14 of the playing card. The winning numeric game symbols are not illustrated on the front surface of the card because the symbols change for every game. They depend upon what numbers are chosen by a conventional random number generator or BINGO blower. Located around the number matrix 22 is the title 24 of the game. If desired, a serial number 26 can also be printed on the front face 20 of the playing card 10.

Each of the cards includes a cover member or other game symbol concealing means, such as a pull tab. With reference once more to FIG. 2, a cover member, such as a pull tab or flap 32 is mounted to the rear surface 14 of the body to define a rear surface 30 of the playing card 10. The flap 32 is defined by a series of perforated lines 34. With reference now also to FIG. 3A, the tab 32 covers a window 36 on the rear surface 14 of the body in which is printed an N×M matrix of numerals 38 which constitutes the playing numbers 40 of the game. In the embodiment illustrated, a 3×3 matrix is shown. However, it should be appreciated that a 4×4, 1×3 or any other desired matrix of numbers, or letters or other alphanumeric characters, or even other types of symbols, could be used. The matrix is arranged like a tic-tac-toe matrix. The nine numbers employed in the game are chosen from the numerals 1–75 such that, for example, any of the numbers 1–25 can be located in the first, or left hand column, any of the numbers 26–50 can be located in the second or central column and any of the numbers 51–75 can be located in the third or right hand column. Of course, it should be appreciated that the number ranges can be varied as desired.

In the illustrated embodiment, the playing cards 10 can have a two ply construction. The first ply would bear the game symbols and the second ply, attached to the first ply, would include substantially rectangular regions frangible on three sides which comprise the flap-like tab 32 which comprises the means for initially concealing the game symbols displayed on the playing card. Although in the illustrated embodiment, game symbols concealing means are achieved through the use of a two-ply playing card construction, it should be appreciated by those of average skill in the art that the game symbol concealing means may have numerous alternative configurations such as other flap-type concealing means or scratch-off seals or the like. Moreover, although in the illustrated embodiment, the entire 3×3 matrix 38 is concealed beneath one flap 32, it would also be contemplated that separate flaps could be employed to conceal one or more sets of the nine numbers of the matrix 38.

As mentioned, the numerals 40 range from 1 to 75. They are arranged in three columns 42, 44, and 46 such that the numerals 1–25 appear in the first column 42; the numerals 26–50 appear in the second column 44 and the numerals 51–75 appear in the third column 46. A variety of different types of games can be played employing the 3×3 or Tic-Tac-Toe matrix. Since the tickets 10 have numbers chosen from the set of numbers 1–75, a standard set of BINGO balls in a BINGO blower can be used.

Figure 3B:
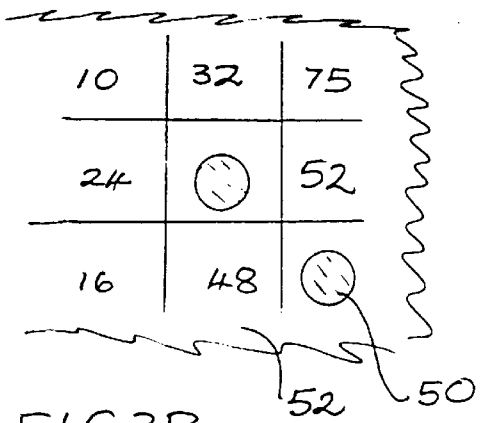
FIG. 3B is a bottom plan view of a portion of a ticket according to a second preferred embodiment.

A scratch-off seal 50, which can be used on a alternate embodiment of a ticket 52 is shown in FIG. 3B.

Alternatively, the cover member, such as flap 32 or seal 50, is eliminated. Obviously, such an embodiment is not generally suitable for playing games in which the winning matrix is displayed prior to purchase of the card.

Figure 4:
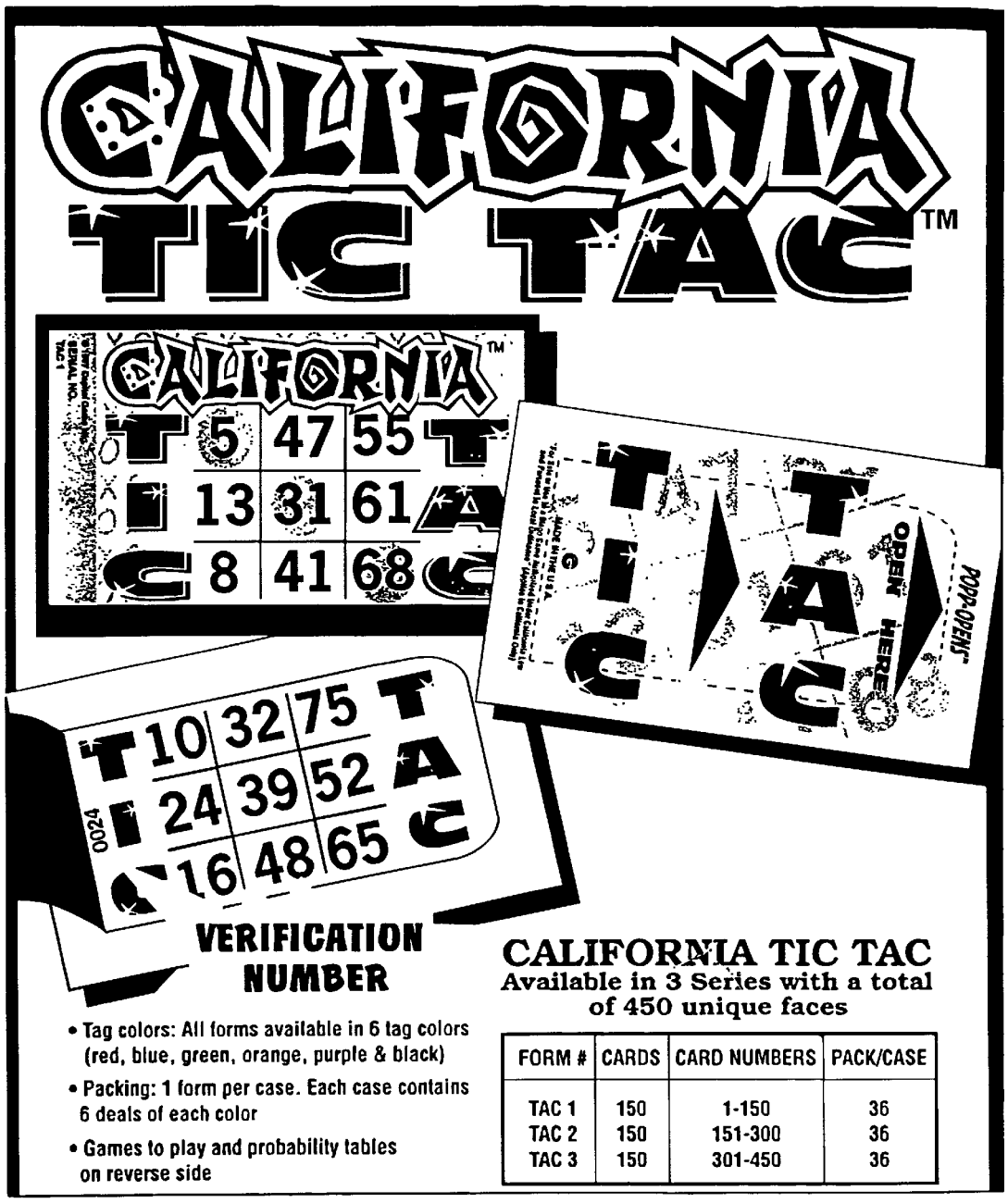
FIG. 4 is a top plan view of a flare used to promote the ticket of the present invention, showing a front side of the flare; and, FIG. 5 is a bottom plan view of the flare of FIG. 4, showing the back side of the flare.

A flare 54 used with the game is shown in FIG. 4. The flare shows a sample ticket and ways of playing the game. The game is very flexible while minimizing the number of multiple winners, i.e. more than one winning or duplicate ticket in a single game. This was accomplished by choosing numbers for the matrix which form unique patterns. More specifically, for each of the 150 to 450 playing cards of the game, there is at least one unique pattern. These unique patterns include horizontal, vertical, and diagonal lines, four corners, the letter X, diamonds, crosses, any two lines, a crazy T, a large frame, and full cover. For example, for the full cover game, each card is different from all other cards by at least three numbers. These unique patterns hold for all 450 cards which are employed in the maximum size game. When there are 150 tickets in play, the game can take as few as 7.72 calls, on average, using any single line game pattern or as many as 42.9 calls, on average, when employing a full cover card game pattern, as is evident from a set of statistics 56, illustrated in FIG. 5. The statistics include the average number of calls, the average number of winners and the percentage of single winners depending upon the pattern which is called to play the game and the number of cards employed in the game.

The average number of calls, i.e. BINGO numbers which are called out to the players of the game, ranges from 5.83, when 450 cards are in play and the winner is a line to 38.66 calls when 450 cards are in play and the winner is a cover all.

The tickets 10 can be played in a plurality of different ways. These include calling balls randomly until a player completes a pre-specified game pattern, which would be similar to a conventional BINGO game. Alternatively, the game proprietor could call a fixed number of balls randomly before the game tickets are sold or distributed and pay out prizes based upon completion of pre-specified patterns allowing an instant prize type of game. This would make the ticket 10 similar to a pull tab-type of game. Yet a third alternative would be to call a fixed number of balls randomly, sell tickets, allow the trading of tickets for new tickets until a specified time and then draw balls randomly until one of the players completes the pre-specified game pattern. This would be similar to a tear-open type game.

No ticket price is set on the ticket and, therefore, no payout is established. The game proprietor can thus design its own game.

The window 36 also includes an area in which one or more alphabetical symbols 58 and 60 can be printed. These symbols can be the name of the game if so desired. In addition, the window 36 also includes an area in which a verification number 62 can be printed. The verification number 62 may be in the form of a bar code which is readable by a suitable machine. Each of the 450 matrices can have its own winning verification number. With each face having a unique verification number, the game proprietor can be provided with a verification table showing all of the 450 matrices. In this way, each person claiming to be a winner can have their alleged winning 3×3 number matrix verified to make sure that the ticket that is presented as a winner is indeed a winning ticket and has not been altered in some way such as, e.g. the number 3 being altered to represent the number 8 or the like.

There are about 1.2 winners on average, with some variation depending upon the pattern in play. If a split pot or multiple winners occur, a tie breaker can be employed by the game proprietor using the verification number. Alternatively, the tie breaker could involve pulling an additional ball from the machine. The winner could arbitrarily be chosen to be the person having the higher verification number or the higher BINGO number pulled or the prizes can be divided among the winning players.

The flare of FIG. 4 illustrates the front side of the ticket, the unopened back side of the ticket and the back side of the ticket when the pull tab has been opened. The flier shows the variety of colors in which the tickets can be printed. Such colors can include red, blue, orange, purple and black. In addition, the tickets can be sold in sets of 150 cards with three such sets being available in a total of 450 unique matrices 38 of the game. Of course, if desired, more than one color can be employed on the ticket. Different colors can be used to allow several games to be played in a session, as a quick visual reference in addition to the serial number. Tickets in different colors can also be used to play different pay lines for a single game.

With reference again to FIG. 1, the front face of the ticket 10 can also include a form number 70. In the ticket of FIG. 1, the form number is identified by the alphanumeric characters "Tac 1". As shown in the flier of FIG. 4, the form numbers are Tac 1, Tac 2 and Tac 3. Each form includes 150 cards which are numbered 1–150; 151–300 and 301–450, respectively.

The invention has been described with reference to the preferred embodiments. Obviously, alterations and modifications will occur to others upon a reading and understanding of this specification.

We claim:

1. A ticket for use in playing a BINGO-type game, the ticket forming one of a set of tickets, the ticket comprising:

a ticket body having a first surface and a second surface;

an nxm matrix of characters printed on the second surface, where n and m are independently at least three, each of the characters being selected from a set of characters and being different from each of the other characters in the matrix, the characters selected such that the matrix differs from matrices of each of the other tickets in the set of tickets; and, a removable cover member secured to said second surface, the cover member concealing all of the characters in the matrix of characters prior to playing the game of chance, the removable cover member revealing all of the characters when removed.

2. The ticket of claim 1, wherein the cover member includes a flap which is connected to the second surface and is perforated around a periphery for tearing open.

3. The ticket of claim 1, wherein the cover member includes at least one scratch off seal which conceals the characters until scratched off.

4. The ticket of claim 1, wherein the matrix of characters is a three character by three character matrix.

5. The ticket of claim 1, wherein the matrix of characters differs from matrices of each of the other tickets in the set by at least three of the characters.

6. The ticket of claim 1, wherein the characters comprise alphanumeric characters.

7. The ticket of claim 6, wherein the characters comprise the set of numbers 1–75.

8. The ticket of claim 1, wherein a spatially arranged group of the characters forms a pattern, the group of characters forming the pattern being different from an equivalently positioned spatially arranged group of characters for each of the other tickets in the set.

9. The ticket of claim 1, wherein the pattern is selected from the group consisting of at least one horizontal line, at least one vertical line, four corners, a diamond shape, full cover, a T-shape, a cross, and a frame.

10. The ticket of claim 1, further comprising a verification number located at one of said first and second surfaces for verifying that the matrix of characters has not been altered.

11. The ticket of claim 10, wherein the verification number is concealed by the cover member.

12. The ticket of claim 1, further comprising a serial number located on one of said first and second surfaces for distinguishing the ticket from other tickets outside the set of tickets.

13. A set of tickets for use in playing a BINGO-type game, each ticket of the set of tickets comprising:

a front surface;

a rear surface;

a three by three matrix of characters printed on one of the front and rear surfaces, each of the characters in the matrix being selected from a set of characters, and being different from each of the other characters in the matrix, the characters selected such that the matrix differs from matrices of each of the other tickets in the set of tickets, each of the tickets having a matrix of characters selected from the same set of characters such that a winning ticket can be determined by selecting characters from the set of characters after distribution of the tickets; and, a removable cover member connected to the one of the front and the rear surfaces and positioned over the matrix of characters for concealing the entire matrix of characters prior to playing the game of chance and revealing the entire matrix once removed.

14. The set of tickets of claim 13, wherein the matrix of characters comprises a 3×3 matrix.

15. The set of tickets of claim 14, wherein the matrix of characters comprise BINGO numbers.

16. The set of tickets of claim 13, wherein the removable cover member comprises a tear-open flap.

17. The set of tickets of claim 13, wherein each ticket comprises a two-ply construction wherein the front and rear surfaces are located on a first ply and the removable cover is formed in a second ply.

18. A method of using a ticket in playing a game of BINGO, the ticket forming one of a set of tickets, the method comprising:

providing a set of tickets wherein each ticket includes a surface having a matrix of characters selected from a set of characters, the entire matrix concealed by a single cover member, each of the characters in the matrix being different from the other characters in the matrix, the characters selected such that the matrix differs from matrices of each of the other tickets in the set of tickets;

removing the cover member from the ticket to reveal the entire matrix of characters;

after the step of providing the tickets, randomly and independently of the ticket, generating characters from the set of characters; and comparing the ticket characters with randomly-generated characters from the set of characters to determine whether a group of the randomly-generated characters corresponds with at least one preselected spatially oriented group of the ticket characters.

19. The method of claim 18, wherein the step of removing the cover member includes the subsidiary step of lifting a concealing flap.

20. The method of claim 18, wherein the step of comparing the ticket characters includes the steps of:

generating a first randomly generated character and comparing the ticket characters with the randomly generated character;

marking the one of the ticket characters if the randomly generated character corresponds with one of the ticket characters; and;

repeating the steps of generating and marking until one of the tickets in the set of tickets is marked with a preselected pattern.

21. A method of playing a game of chance, comprising:

a) distributing tickets from a set of tickets wherein each ticket in the set of tickets includes a surface displaying a three by three matrix of characters, each character being selected from a set of characters and concealed by a cover member, each of the characters being different from each other character in the matrix;

b) removing the cover members from the tickets to reveal the entire matrix of characters;

c) after distributing the tickets, separately generating a character from the set of characters;

d) comparing the ticket characters with the generated character from the set of characters; and, repeating steps c) and d) until one of a preselected spatially orientated group of characters in the matrix corresponds with a group of the generated characters, thereby determining a winning ticket, the tickets being free of any indication which would allow a determination of which of the tickets are winning tickets prior to completion of step (d).

22. The method of claim 21 wherein each matrix in the set of tickets differs from each other matrix in the set of tickets.

23. A set of tickets for use in playing a game of chance, each ticket of the set of tickets comprising:

a front surface;

a rear surface;

a three by three matrix of characters printed in a defined area on one of said front and rear surfaces, wherein each character of said matrix is different from each other character of said matrix;

a single cover member overlying said defined area to cover all of the characters in said matrix and selectively removable therefrom to expose all of the characters in said matrix.

24. The set of tickets of claim 23, wherein the cover member includes a flap which is connected to the rear surface and is perforated around a periphery for tearing open.

25. The set of tickets of claim 23, wherein the cover member includes a scratch off seal which conceals the characters until scratched off.

26. The set of tickets of claim 23, wherein the matrix of characters differs from matrices of each of the other tickets in the set by at least three of the characters.

27. The set of tickets of claim 23, wherein the characters comprise alphanumeric characters.

28. The set of tickets of claim 27, wherein the characters comprise the set of numbers 1–75.

29. The set of tickets of claim 23, wherein a spatially arranged group of the characters forms a pattern, the group of characters forming the pattern being different from an equivalently positioned spatially arranged group of characters for each of the other tickets in the set.

30. The set of tickets of claim 23, wherein the pattern is selected from the group consisting of at least one horizontal line, at least one vertical line, four corners, a diamond shape, full cover, a T-shape, a cross, and a frame.

31. The set of tickets of claim 23, further comprising a verification number located on one of said front and rear surfaces for verifying that the matrix of characters has not been altered.

32. The set of tickets of claim 31, wherein the verification number is concealed by the cover member.

33. The set of tickets of claim 23, further comprising a serial number located on one of said front and rear surfaces for distinguishing the ticket from other tickets outside the set of tickets.

34. The set of tickets of claim 23, wherein each ticket comprises a two-ply construction wherein the front and rear surfaces are located on a first ply and the removable cover is formed in a second ply.

* * * * *